US009616700B2

(12) United States Patent
Horn

(10) Patent No.: US 9,616,700 B2
(45) Date of Patent: Apr. 11, 2017

(54) RING BINDER MECHANISM

(71) Applicant: Hans Johann Horn, Bern (CH)

(72) Inventor: Hans Johann Horn, Bern (CH)

( * ) Notice: Subject to any disclaimer, the term of this patent is extended or adjusted under 35 U.S.C. 154(b) by 366 days.

(21) Appl. No.: 14/359,199

(22) PCT Filed: Jan. 8, 2013

(86) PCT No.: PCT/EP2013/050183

§ 371 (c)(1),
(2) Date: May 19, 2014

(87) PCT Pub. No.: WO2013/107668

PCT Pub. Date: Jul. 25, 2013

(65) Prior Publication Data

US 2014/0321899 A1 Oct. 30, 2014

(30) Foreign Application Priority Data

Jan. 17, 2012 (DE) ..... 10 2012 200 589

(51) Int. Cl.
*B42F 13/26* (2006.01)

(52) U.S. Cl.
CPC ..... *B42F 13/26* (2013.01)

(58) Field of Classification Search
CPC ..... B42F 13/26
(Continued)

(56) References Cited

U.S. PATENT DOCUMENTS 3,827,111 A * 8/1974 O'Connell ..... B42F 13/26 402/36

5,618,122 A * 4/1997 Constantine ..... B42F 13/22 402/31

(Continued)

FOREIGN PATENT DOCUMENTS

DE 10 2009 005 341 A1 7/2010
EP 1 908 603 A2 4/2008
WO WO 2005113254 A1 * 12/2005 ..... B42F 13/26

OTHER PUBLICATIONS

International Search Report of PCT/EP2013/050183, mailed Apr. 9, 2013.

(Continued)

*Primary Examiner* — Kyle Grabowski
(74) *Attorney, Agent, or Firm* — Collard & Roe, P.C.

(57) ABSTRACT

A ring binder mechanism has at least two semi-ring pairs, which are arranged spaced apart from one another and which each consist of two semi-rings (20, 20'), the semi-rings (20) of a first group and the semi-rings (20') of a second group being rigidly connected to one another in a grouped manner in the area of their roots and thereby kept spaced apart from one another. Mutually complementary locking bar elements (44, 44'), which, in the closed position, are locked to prevent pivoting of the semi-rings relative to one another, are arranged at the ends of the semi-rings (20, 20') of at least one of the semi-ring pairs. In a free position, the semi-rings (20, 20') allocated in pairs span a common radial plane (46), and the locking bar elements (44, 44') thereof are spaced radially apart from one another, and in the locked position, the locking bar elements (44, 44') are coupled to one another with a form fit in all directions within the tangential plane (48) of the rings (19) which intersects the locking bar elements (44, 44') and is perpendicular to the radial plane (46).

22 Claims, 18 Drawing Sheets

Figures 1A, 1B:
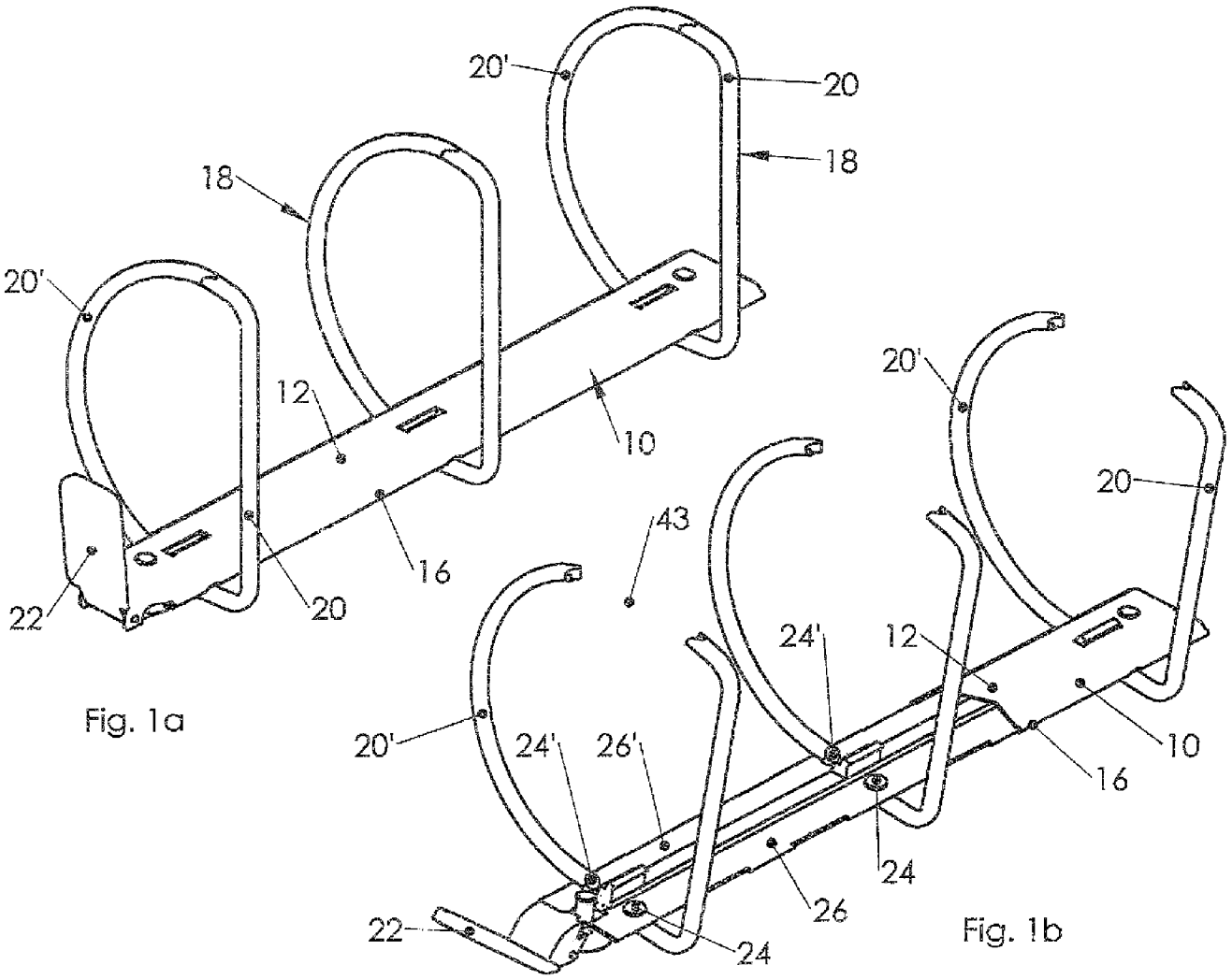

(58) Field of Classification Search
USPC ..... 402/39
See application file for complete search history.

(56) References Cited

U.S. PATENT DOCUMENTS

| | | | | |
|---|---|---|---|---|
| 6,203,229 | B1 * | 3/2001 | Coerver | B42F 13/26 402/38 |
| 6,328,497 | B1 * | 12/2001 | To | B42F 13/26 402/36 |
| 8,480,327 | B2 | 7/2013 | Horn | |
| 2005/0271459 | A1 * | 12/2005 | To | B42F 13/22 402/31 |
| 2008/0080926 | A1 | 4/2008 | Liu et al. | |
| 2008/0175651 | A1 * | 7/2008 | Cheng | B42F 13/26 402/31 |
| 2009/0285623 | A1 | 11/2009 | Whaley | |
| 2010/0150642 | A1 * | 6/2010 | Lee | B42F 13/26 402/24 |
| 2010/0316435 | A1 * | 12/2010 | Gilbert | B42F 13/26 402/39 |
| 2011/0305500 | A1 * | 12/2011 | To | B42F 13/26 402/36 |

OTHER PUBLICATIONS

German Office Action in DE 10 2012 200 589.7, dated Aug. 23, 2012, with English translation of relevant parts.

* cited by examiner

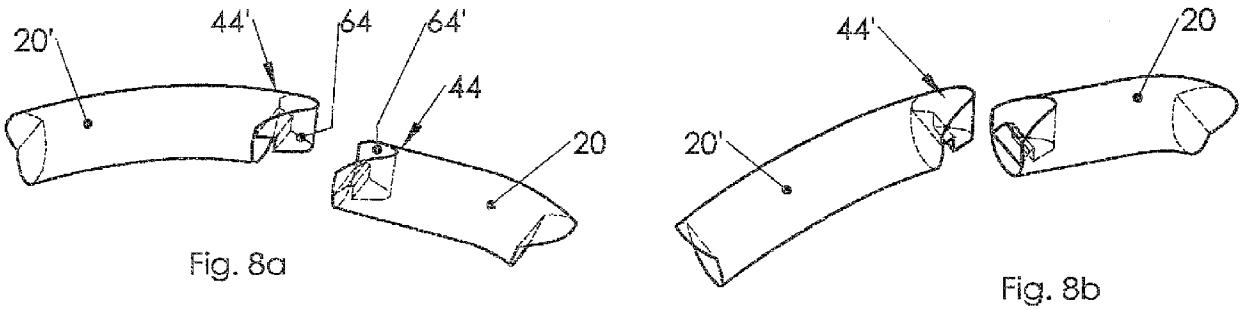
Fig. 8a
Fig. 8b
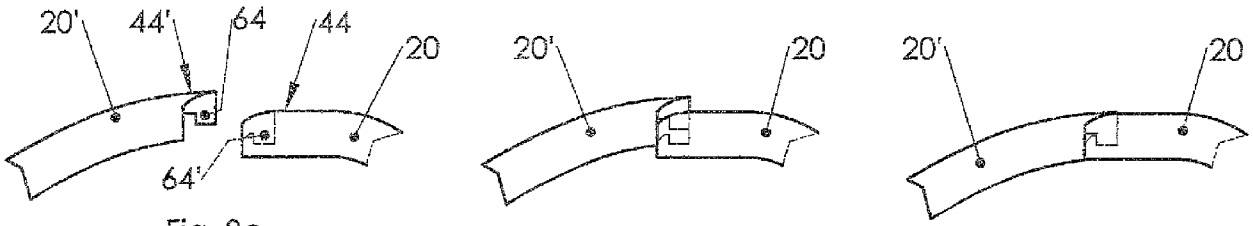
Fig. 8c
Fig. 8d
Fig. 8e
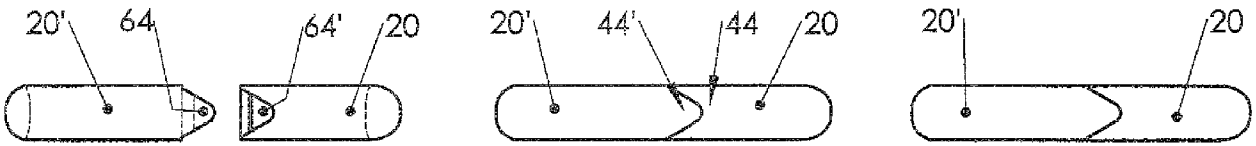
Fig. 8f
Fig. 8g
Fig. 8h

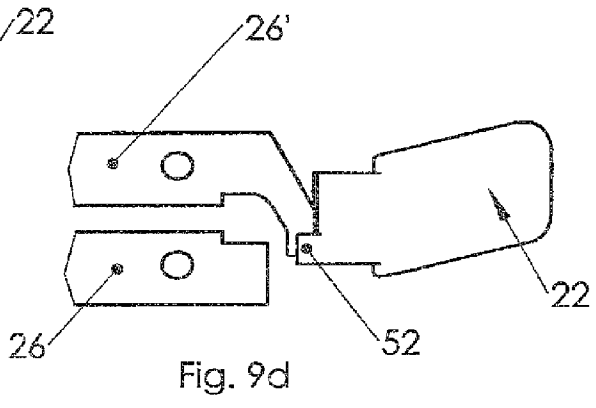
Fig. 9a
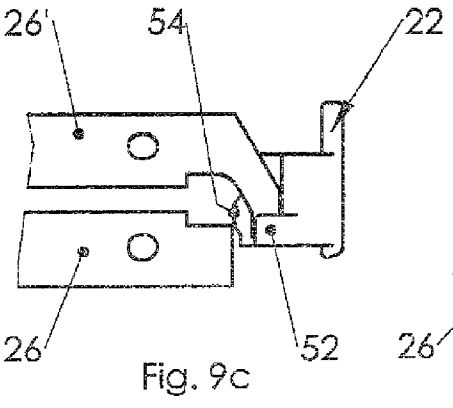
Fig. 9c
Fig. 9d
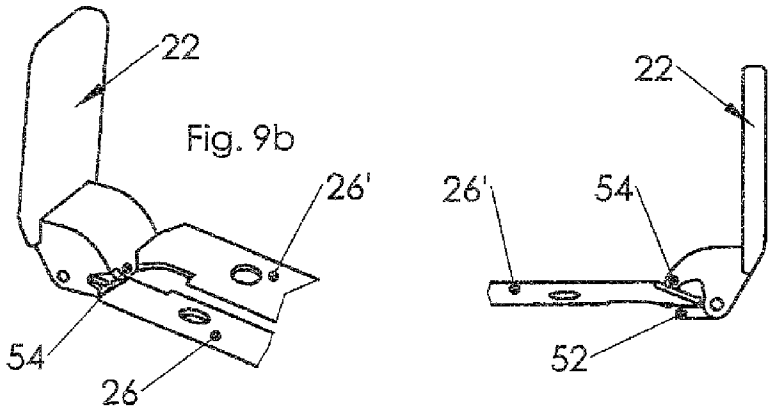
Fig. 9b
Fig. 9e
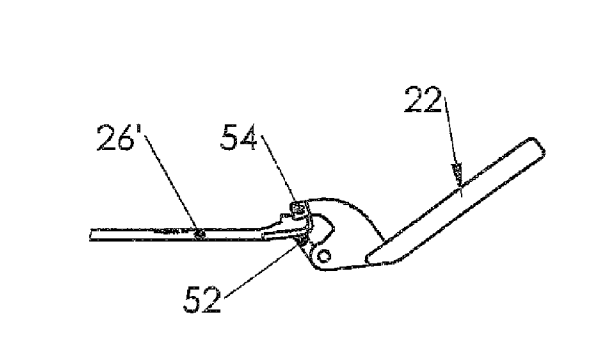
Fig. 9f 20
38
70
72
20'
10
77
56
38
76

38
30
38
76

70
72
56
77
74

38
30
10
38
20
56'
78
72'

38
30
38
36'
38
84

80
83
56'
78

38
84
30
82

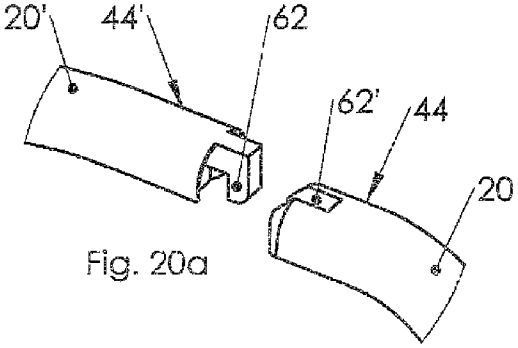
Fig. 20a
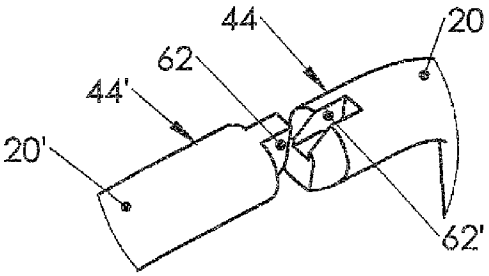
Fig. 20b
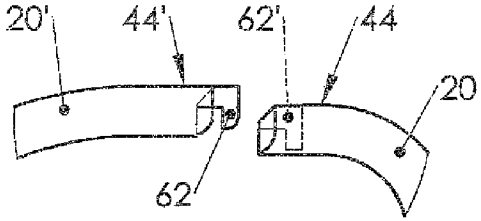
Fig. 20c
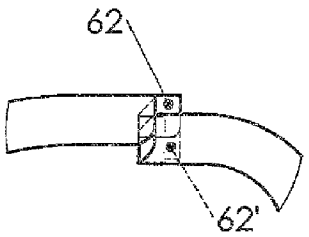
Fig. 20d
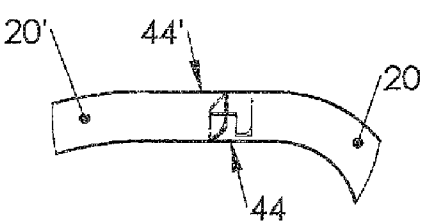
Fig. 20e
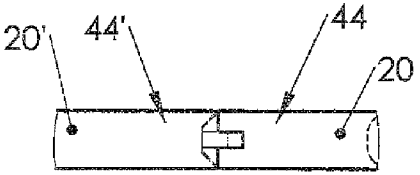
Fig. 20f
Fig. 20g
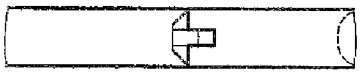
Fig. 20h

RING BINDER MECHANISM

CROSS REFERENCE TO RELATED APPLICATIONS

This application is the National Stage of PCT/EP2013/050183 filed on Jan. 8, 2013, which claims priority under 35 U.S.C. §119 of German Application No. 10 2012 200 589.7 filed on Jan. 17, 2012, the disclosure of which is incorporated by reference. The international application under PCT article 21(2) was not published in English.

The invention relates to a ring binder mechanism having at least two half-ring pairs which are arranged spaced apart from one another and which each consist of two half-rings, wherein the half-rings of a first group and the half-rings of a second group are rigidly connected to one another in a grouped manner in the region of their roots and thereby kept apart from one another, said half-rings complementing one another in pairs to form the half-ring pairs and being able to be pivoted together relative to the respective other group between an open position opening up an insert gap between their free ends and a closed position, complementing one another to form one respective closed ring, wherein at the ends of the half-rings of at least one of the half-ring pairs, mutually complementary locking bar elements are arranged, said locking bar elements being locked together in the closed position to prevent pivoting of the half-rings, wherein at the start of an opening procedure at least one of the half-rings of the half-ring pairs is able to be moved relative to the other half-ring by initiating an unlocking procedure between a locked position and a released position of the associated locking bar elements, wherein during the course of a locking procedure at least one of the half-rings of the half-ring pairs is able to be moved relative to the other half-ring between the released position and the locked position of the associated locking bar elements, and wherein in the locked position the half-rings associated with one another in pairs span a common radial plane and the locking elements thereof are positively coupled together at least in the direction of movement toward the open position.

A ring binder mechanism of this type is disclosed, for example, in DE-10 2009 005 341 A1. Here, the locking elements ensure that the closing force of the half-ring pairs is improved by said half-ring pairs being positively locked together at their free ends in the closed state. This is achieved by the carrier rails of the ring binder mechanism arranged in the housing not only carrying out the conventional tilting movement about the axis of articulation but by being additionally displaceable relative to one another parallel to the axis of articulation. In order to permit this, a control member is provided at this point, said control member having a guide slot fixed to the housing and a tab-like sliding member arranged on one of the carrier rails, engaging in the guide slot or bearing thereagainst. By means of these measures, it is achieved that in the closed state the half-rings are interlocked in the region of the locking elements such that they are not able to be easily pulled apart in the opening direction. The positive connection between the locking elements ensures that, even with heavy loads of paper on one or on both half-rings, the ring is prevented from gaping open. For producing the hook connection, however, a mutual displacement of the ring halves was required in the longitudinal direction of the mechanism. It has been shown that in the case of large mechanisms filled with a large quantity of paper, considerable resistance counteracts the secure closing of the locking bar elements and thus of the rings.

In order to prevent the rings from gaping open, a high spring force is required, i.e. a high degree of pretensioning of the housing flanks and a high spring force for the longitudinal displacement of the bearing axle, which ensure that the locking bar elements are reliably pulled toward one another.

Proceeding therefrom, the object of the invention is that a longitudinal displacement of the ring halves and the carrier rails is unnecessary and that a reliable locking of the locking bar elements in all directions is ensured, irrespective of the spring force in the region of the housing flanks.

To achieve this object, the combination of features set forth in claim 1 is proposed. Advantageous embodiments and developments of the invention are revealed from the dependent claims.

The solution according to the invention is primarily based on the idea that, in the released position, the half-rings associated with one another in pairs span a common radial plane and the locking bar elements thereof are radially spaced apart from one another and in that, in the locked position, the locking bar elements are positively coupled together in all directions within the tangential plane of the rings which is perpendicular to the radial plane and which intersects the locking bar elements. This has the result that the locking is effective between the locking bar elements of the half-rings associated with one another in the tangential plane.

A preferred embodiment of the invention provides that in the locked position the locking bar elements additionally come into contact with one another perpendicular to the tangential plane and in that the half-ring pairs, in the locked position of their locking bar elements, are positioned without radial clearance in the region of their roots.

In order to permit a decoupling procedure and a coupling procedure which is able to be reproduced in such a locking mechanism, according to a preferred embodiment of the invention it is proposed that both during the decoupling procedure and during the coupling procedure, the two half-ring groups carry out a common, aligned pivoting movement about pivot axes parallel to one another in the region of the half-ring roots between the locked position and the released position of the locking bar elements.

It has proved particularly advantageous if the locking bar elements of the half-rings belonging to a half-ring pair have mutually complementary latching elements, which engage in one another radially and produce a positive connection in the peripheral direction and transversely to the peripheral direction. To this end, different variants are conceivable:

- one portion of the latching elements has the form of mutually complementary transverse ribs and transverse grooves;
- one portion of the latching elements has the form of mutually complementary longitudinal ribs and longitudinal grooves;
- one portion of the latching elements has the form of mutually complementary hook elements and hook receivers;
- one portion of the latching elements has the form of mutually complementary cams and cam receivers;
- one portion of the latching elements has the form of mutually complementary prisms and prism receivers able to be joined together radially.

Advantageously, the transverse ribs, longitudinal ribs, hook elements and/or cams and the associated transverse grooves, longitudinal grooves, hook receivers and/or cam receivers have cross sections which may be joined together radially, from the group including a rectangle, trapezium and/or partial circle.

A further preferred embodiment of the invention provides that the ring binder mechanism comprises an elongate housing which is C-shaped or U-shaped in cross section, which has a central housing wall and two housing flanks bent back laterally relative to the central housing wall forming bearing grooves. Moreover, two elongate carrier rails arranged in the housing are provided, said carrier rails, operatively connected to control means arranged between the longitudinal edges, forming a joint mechanism in the region of their longitudinal edges facing one another and with their longitudinal edges remote from one another engaging in the bearing grooves of the housing flanks, wherein the half-rings of one of the half-ring groups are rigidly arranged on each carrier rail, wherein in each case two pairs of half-rings associated with one another within the groups, on the outside of the housing, form half-ring pairs complementing one another in the closed position to form a ring, wherein the carrier rails are pivotable to a limited extent relative to one another via the joint mechanism along a pivoting path by driving the half-rings between the open position and the closed position, wherein at least one of the carrier rails is able to be moved relative to the other carrier rail by initiating an unlocking procedure along an unlocking path between a locked position and a released position of the associated locking bar elements, and wherein the at least one carrier rail is able to be moved relative to the other carrier rail by initiating a locking procedure along a locking path between the released position and the locked position of the associated locking bar elements.

In this case, a preferred embodiment of the invention provides that during the course of the opening and closing procedure the carrier rails are pivotable in the same direction by the action of the control means, between the locked and the released position of the associated ring elements, and the carrier rails are pivotable in opposing directions about their longitudinal axis between the released position and the open position of the associated half-rings.

It is advantageous in this case if the control means form a control rail which is rotatable to a limited extent about a longitudinal axis parallel to the housing longitudinal axis and which is transversely displaceable, said control rail having two longitudinal grooves open on opposing sides, into which in each case one of the carrier rails engages with its longitudinal edge facing inwardly, forming an axis of articulation, wherein during the opening and closing procedure the control rail is displaceable on a displacement portion transversely to the longitudinal axis thereof by the action of a control cam supported on at least one guide surface fixed to the housing, by pivoting the half-rings in opposing directions along the pivoting path between the open position and the released position of the locking bar elements, and the control rail is rotatable to a limited extent on a pivot portion by pivoting the half-rings in the same direction along the locking path between the released position and the locked position of the associated locking bar elements.

Advantageously, in this case the central housing wall has at least one guide opening for the passage of the at least one control cam on the displacement portion of the control rail, whilst the central housing wall also has a guide surface for the control cam on the pivot portion of the control rail, said guide surface being adjacent to the guide opening on the inside of the housing and being aligned transversely to the longitudinal extent of the housing. Advantageously, at the end of the locking path the control cam comes into contact with a stop fixed to the housing, said stop being aligned with a guide wall of the guide opening and ensuring that the control rail is no longer rotated on the adjoining displacement portion.

According to a further preferred embodiment of the invention, an actuating member is provided, said actuating member having at least one opening and closing arm acting on one of the carrier rails in the opening and closing direction. By means of the actuating member, the control rail is rotated about its longitudinal axis in one direction during the unlocking procedure by the action of the opening arm on the relevant carrier rail, whilst said control rail is rotated about its longitudinal axis in the other direction during the locking procedure by the action of the closing arm on the relevant carrier rail and/or a spring force. An automatic locking along the locking path may be achieved if the control rail is pretensioned by the action of a spring force in the operative direction toward the locked position of the locking bar elements. This may take place by the control rail being pretensioned in the operative direction toward the locked position, by the action of a spring force transmitted via the resilient housing flanks and the carrier rails onto the control rail. To this end, the longitudinal grooves of the control rail may be offset vertically to one another relative to the cross section, such that by the action of the spring force a torque is formed which pretensions the control rail in the operative direction toward the locked position. Moreover, a spring may be provided, fixed at its one end to the housing and fixed at its other end to the control rail, via which the control rail is pretensioned in the direction of the locked position.

Figure 3B:
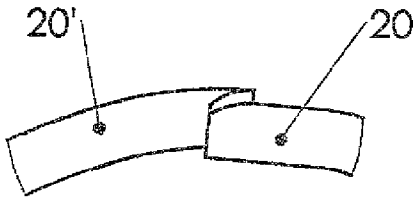
Figure 3A:
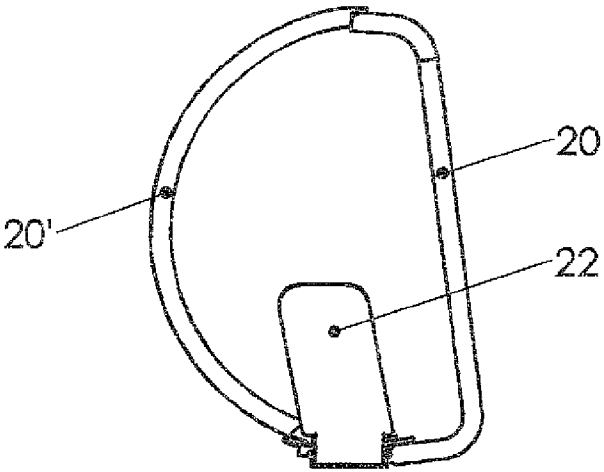
Figure 2:
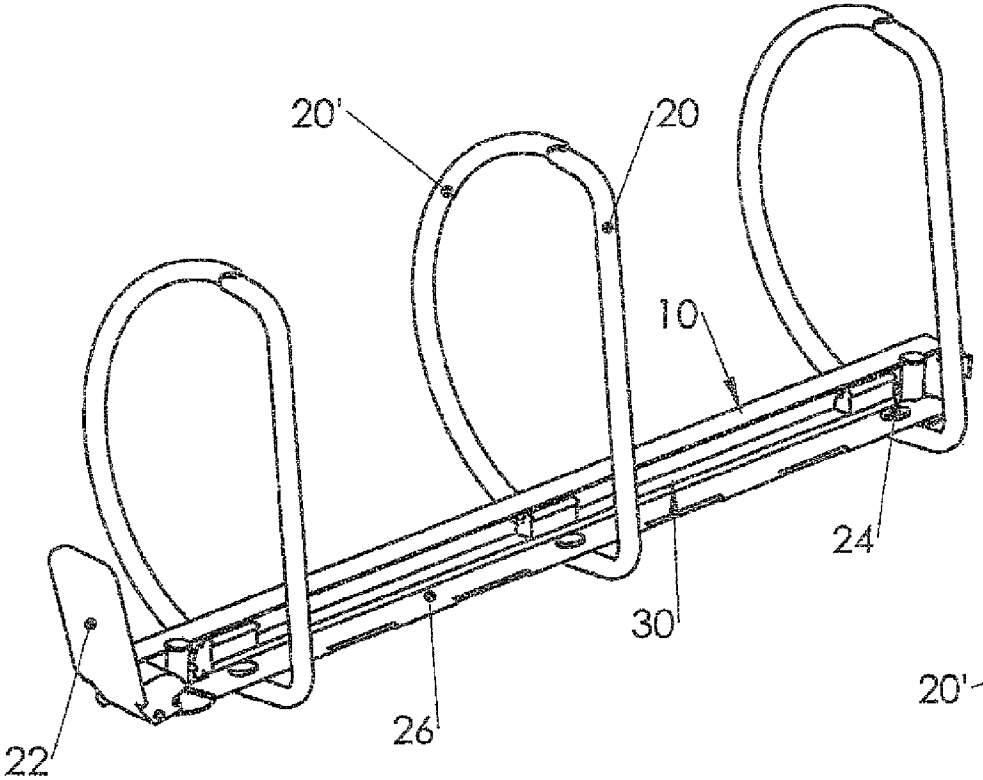
Figure 4:
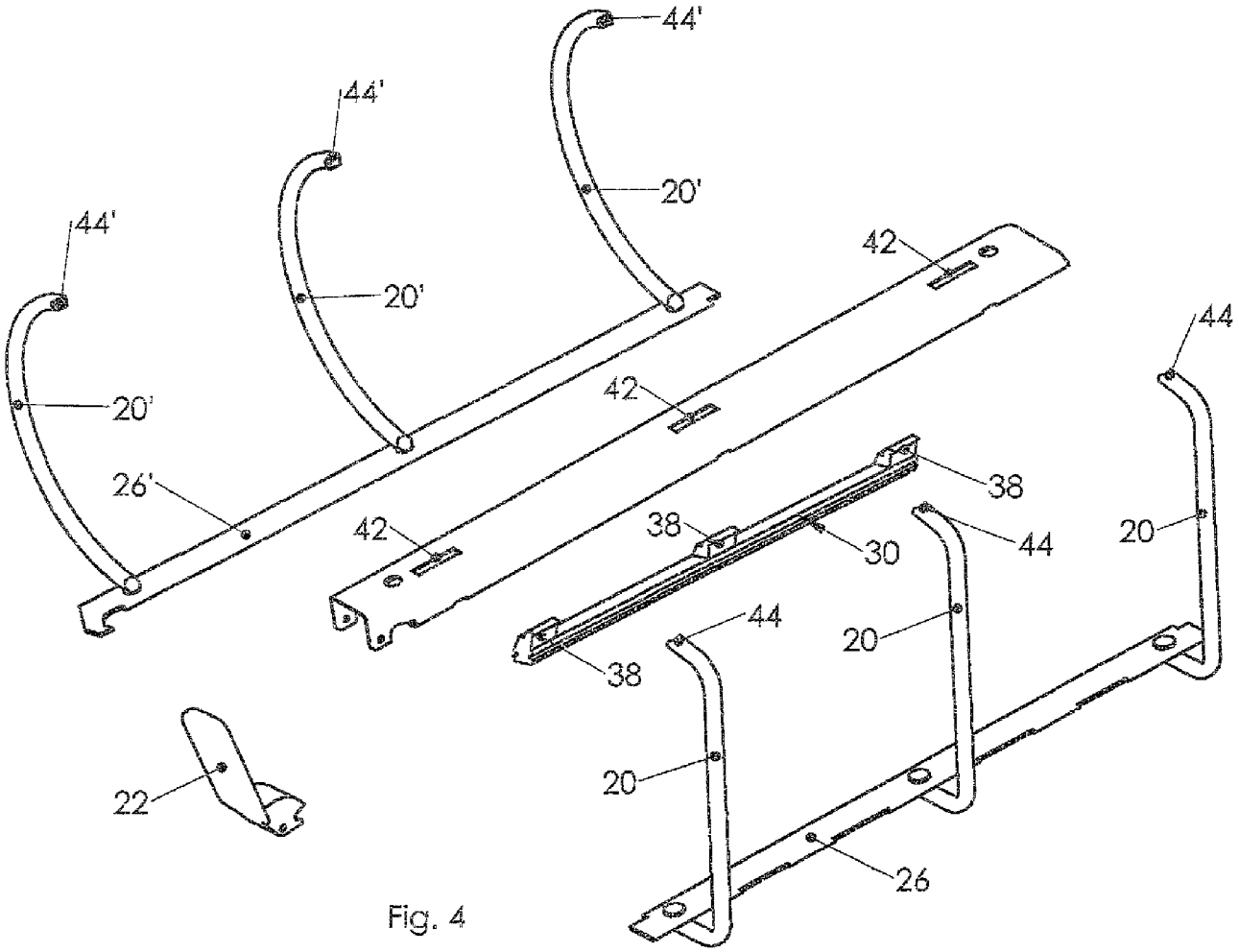
Figure 5A:
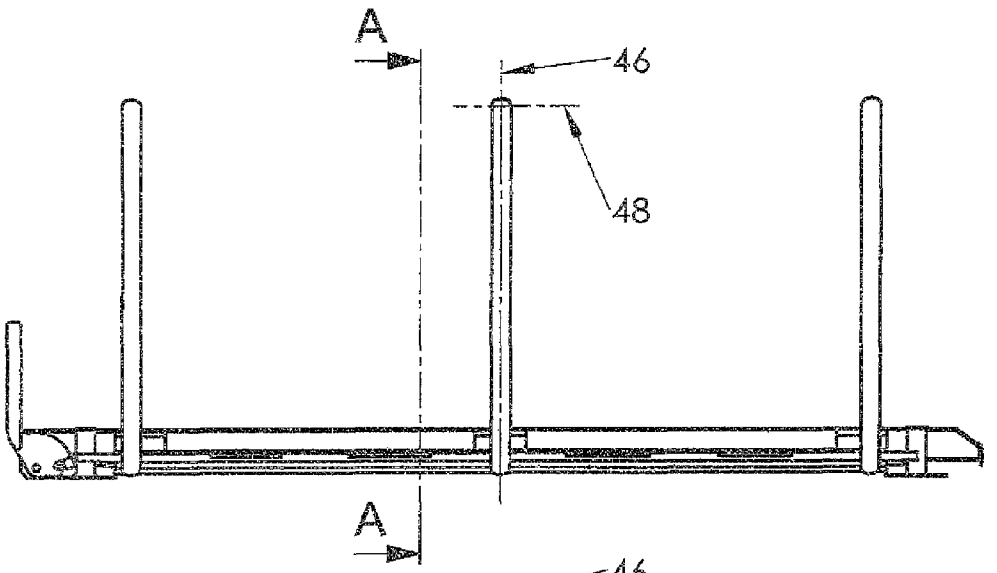
Figure 6C:
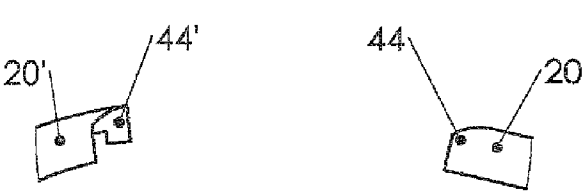
Figure 6C:
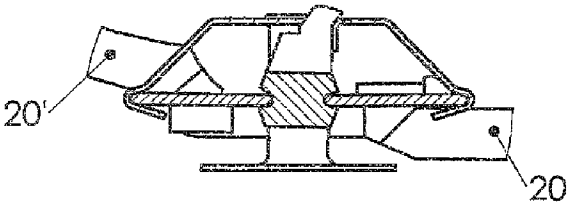
Figure 6D:
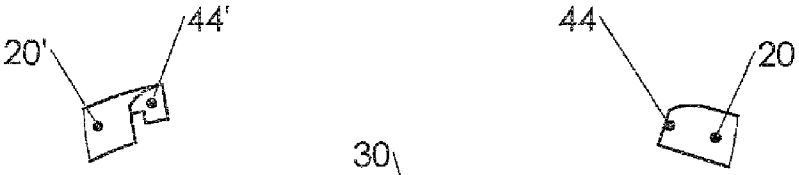
Figure 6D:
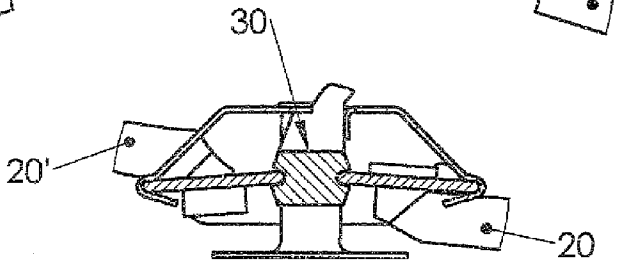
Figure 6A:
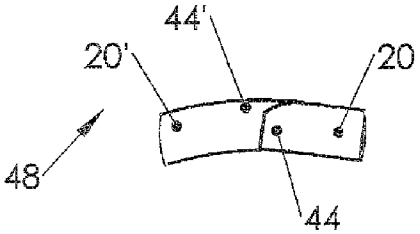
Figure 6A:
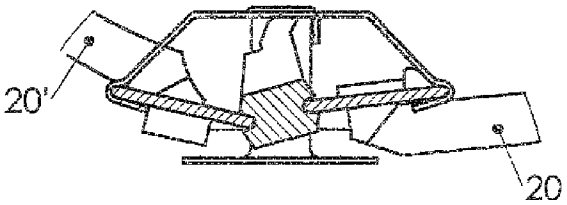
Figure 6B:
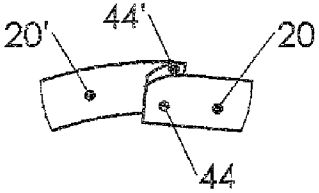
Figure 6B:
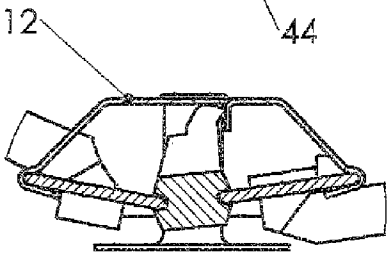
Figure 7:
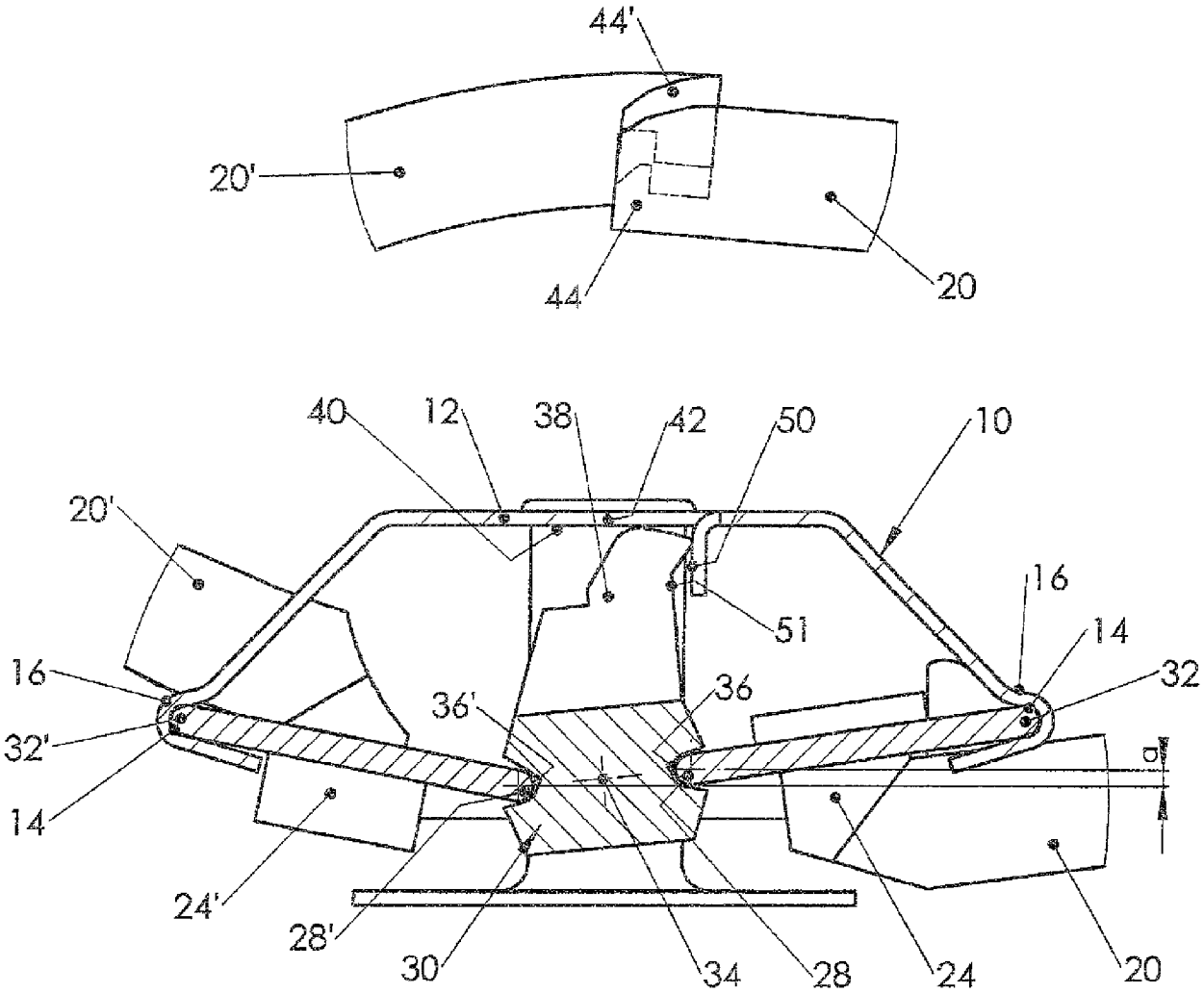
Figure 10B:
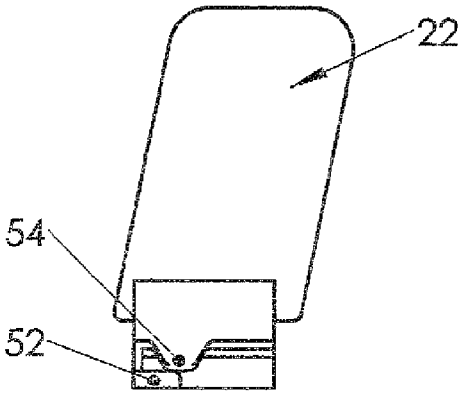
Figure 10A:
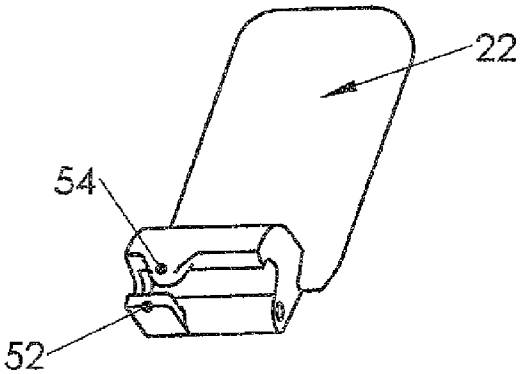
Figure 10C:
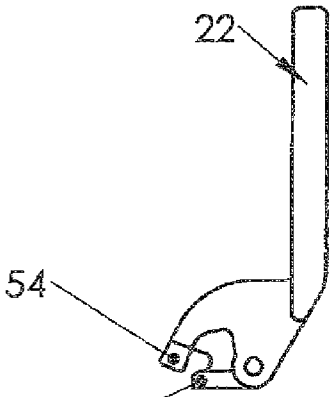
Figure 10D:
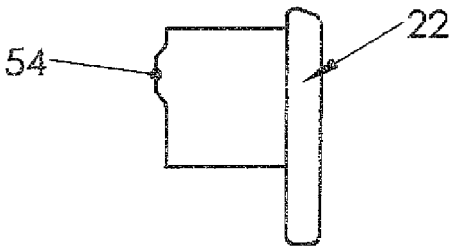

The invention is described in more detail hereinafter with reference to the exemplary embodiments shown schematically in the drawings, in which:

FIGS. 1*a* and *b* show a first exemplary embodiment of a ring binder mechanism in the locked closed state and in the open position in a partially exploded schematic view;

FIG. 2 shows the ring binder mechanism according to FIG. 1 in the unlocked closed position in an exploded schematic view;

FIGS. 3*a* and *b* show a front side view of the ring binder mechanism according to FIG. 2 as well as an enlarged detail of the half-rings;

FIG. 4 shows the ring binder mechanism according to FIGS. 1 and 2 in a schematic exploded view;

FIGS. 5*a* and *b* show in each case an exploded side view of the ring binder mechanism according to FIGS. 1 and 2 in the locked and the unlocked closed position;

FIGS. 6*a* to *d* show a section along the cutting line A-A of FIG. 5*a* in the locked closed position, in the unlocked closed position, in the partially open state and in the open position;

FIG. 7 shows an enlarged view of the sectional view according to FIG. 6*b;*

Figure 11C:
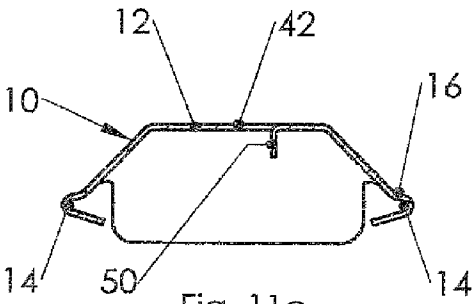
Figure 12B:
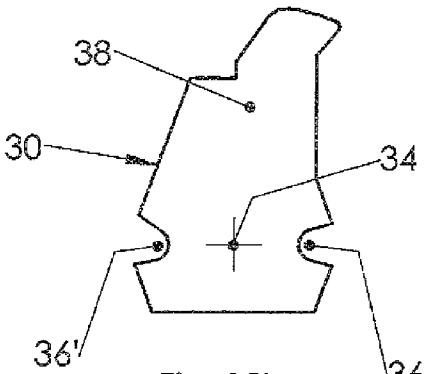
Figure 11A:
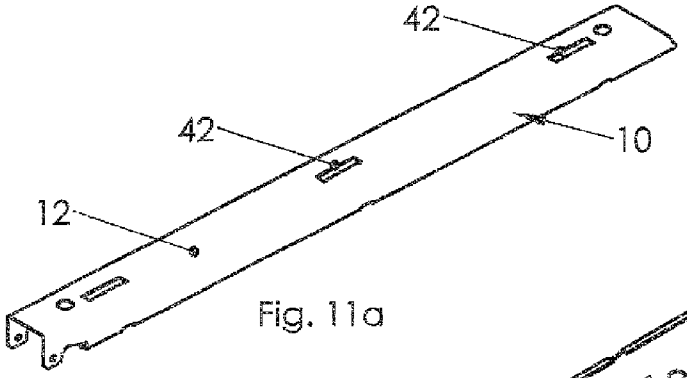
Figure 11B:
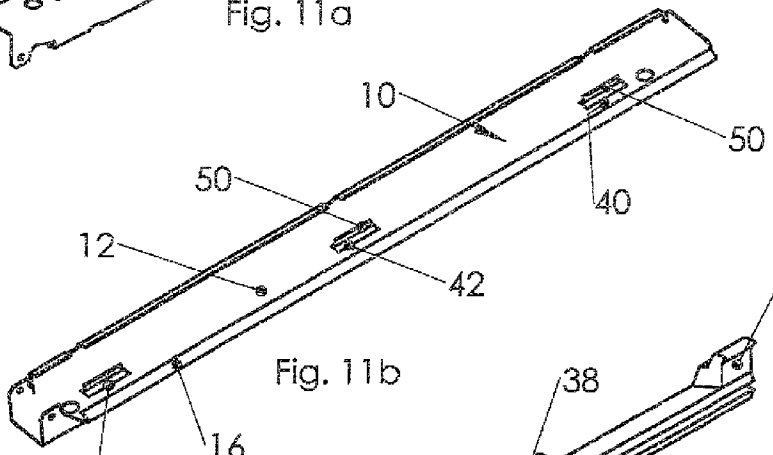
Figure 12A:
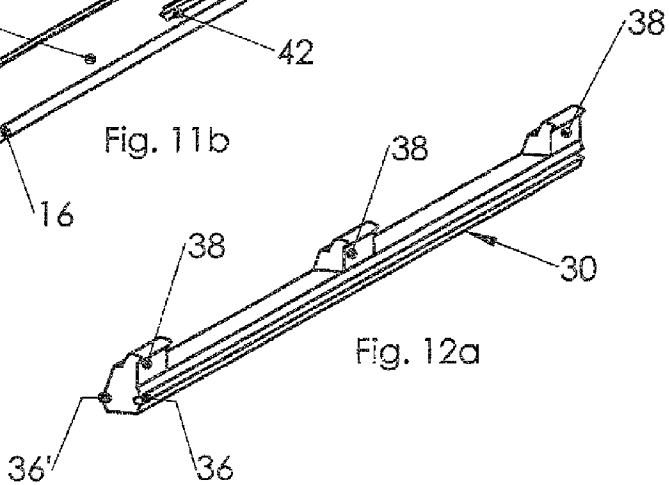
Figure 13A:
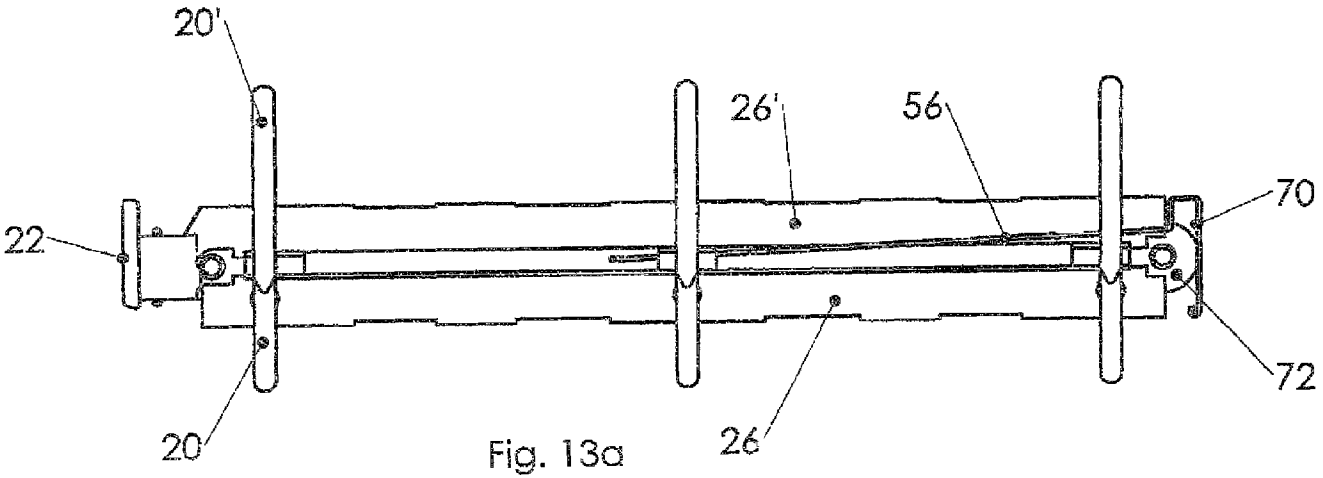
Figure 13B:
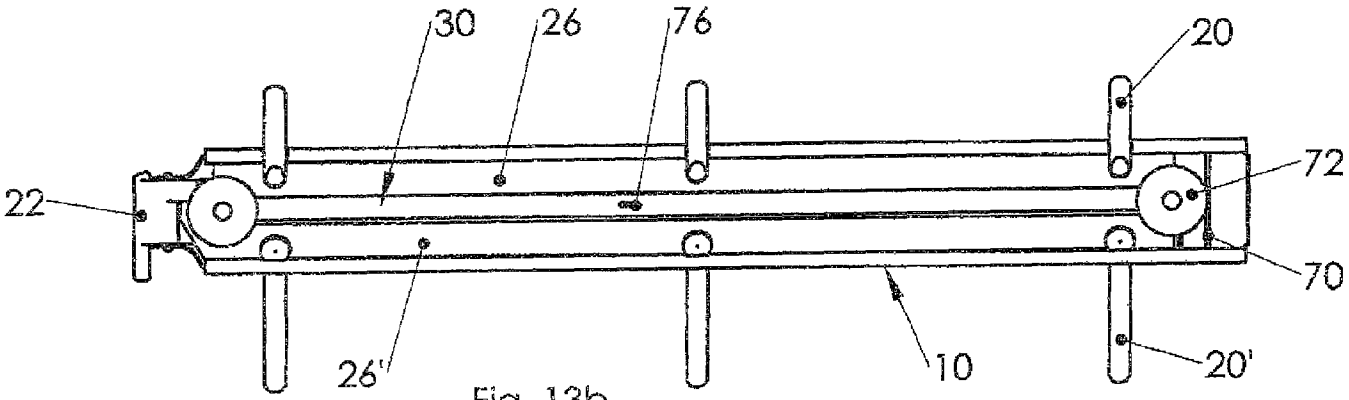
Figures 13C, 13D, 13E:
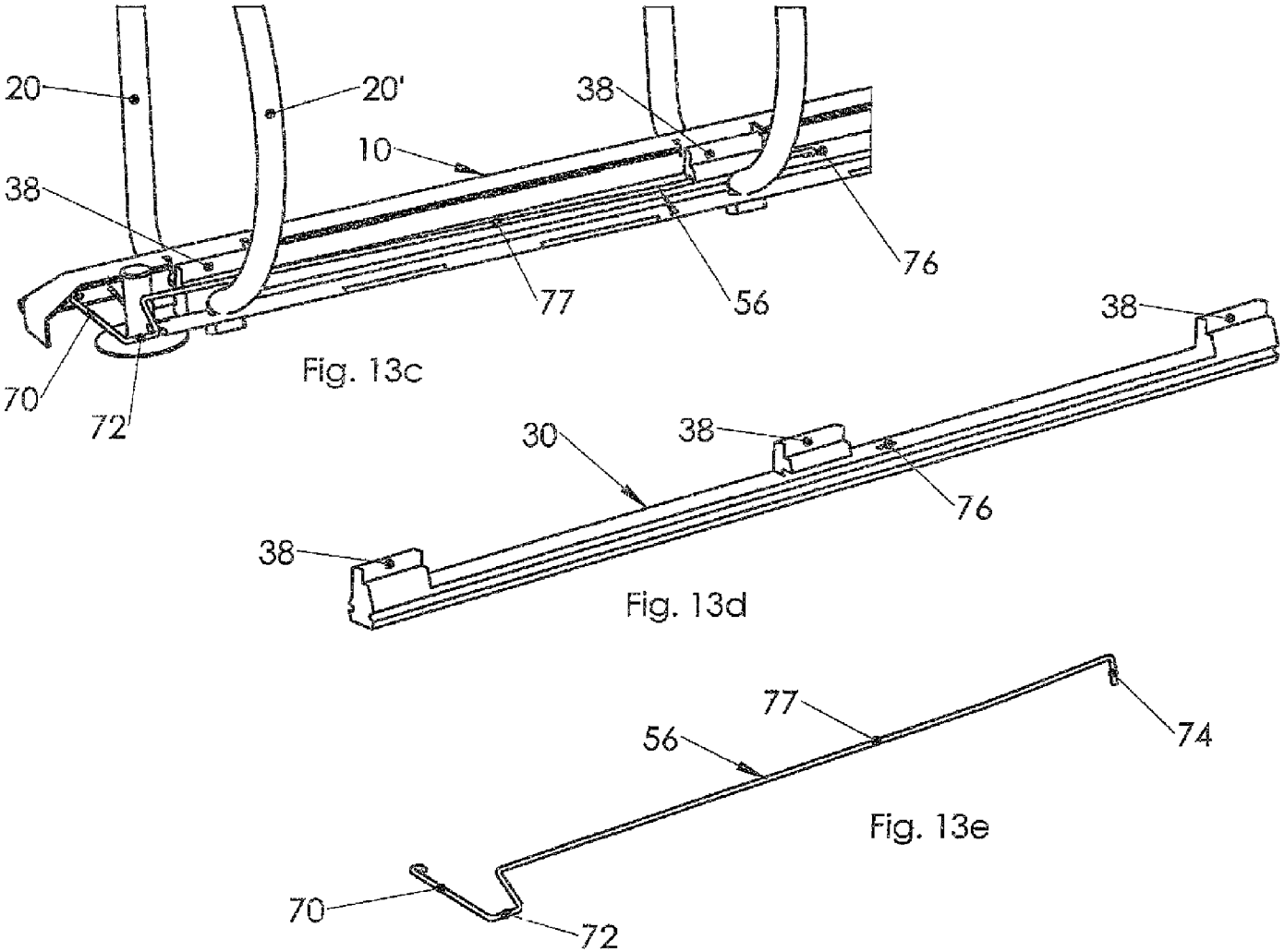

FIGS. 8*a* to *h* show the locking elements of two adjacent half-rings in two open schematic views as well as in three respective side views and plan views in the open position (FIGS. 8*c* and *f*), in the unlocked closed position (FIGS. 8*d* and *g*) and in the locked closed position FIGS. 8*e* and *h*);

FIGS. 9*a* to *f* show an exemplary embodiment of an actuating member with a closing arm and opening arm as well as two carrier rails in two schematic views and two different side views in the locked closed position and two side views in the open position;

FIGS. 10*a* to *d* show the actuating lever according to FIG. 9 in a schematic view and three different side views;

FIGS. 11*a* to *c* show the housing of the ring binder mechanism according to FIG. 1*a* in a schematic plan view and a view from below as well as in an enlarged sectional view;

FIGS. 12*a* and *b* show a schematic view and an enlarged front side view of the control rail of the ring binder mechanism;

FIGS. 13*a* to *c* show a partially exploded plan view, a view from below and an exploded schematic view of the ring binder mechanism with a pretensioning spring;

FIGS. 13*d* and *e* show a detailed schematic view of the control rail and the pretensioning spring of the ring binder mechanism according to FIGS. 13*a* to *c;*

Figure 14C:
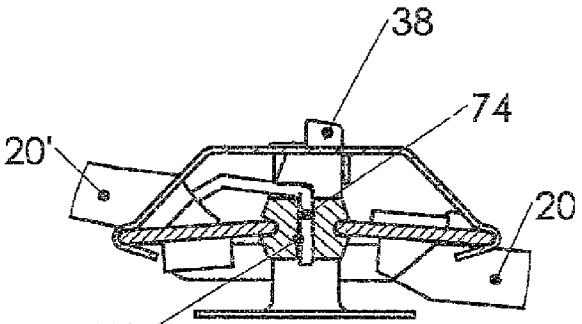
Figure 14B:
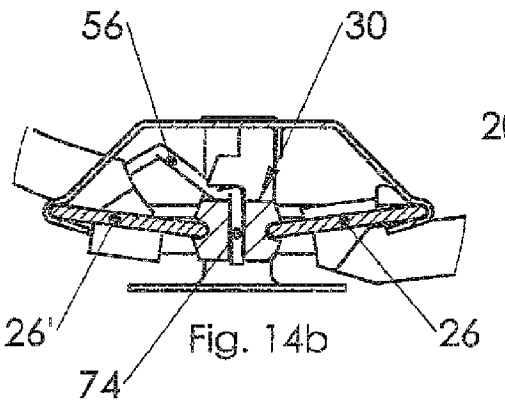
Figure 14A:
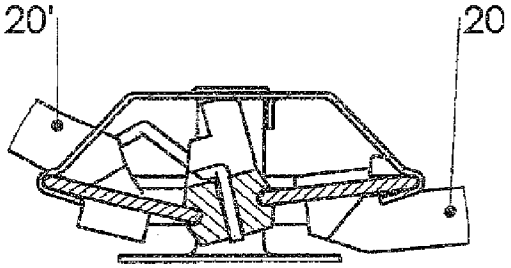

FIGS. 14*a* to *c* show a section through the ring binder mechanism with the pretensioning spring in views according to FIG. 6*a*, FIG. 6*b* and FIG. 6*d;*

Figure 15C:
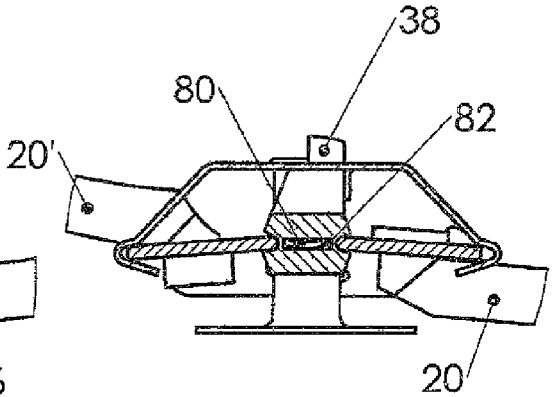
Figure 15B:
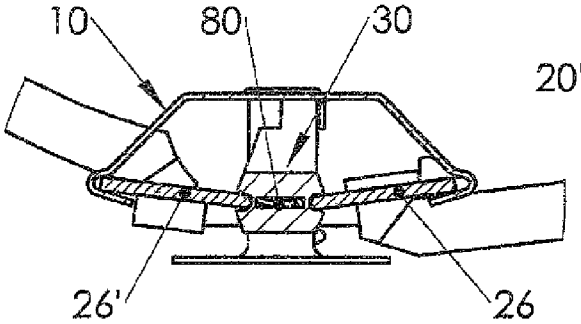
Figure 15A:
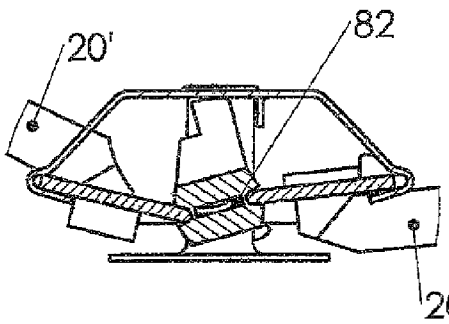

FIGS. 15*a* to *c* show a section through a modified exemplary embodiment of the ring binder mechanism in views according to FIGS. 6*a*, 6*b* and 6*d;*

Figures 16A, 16B, 16C, 16D:
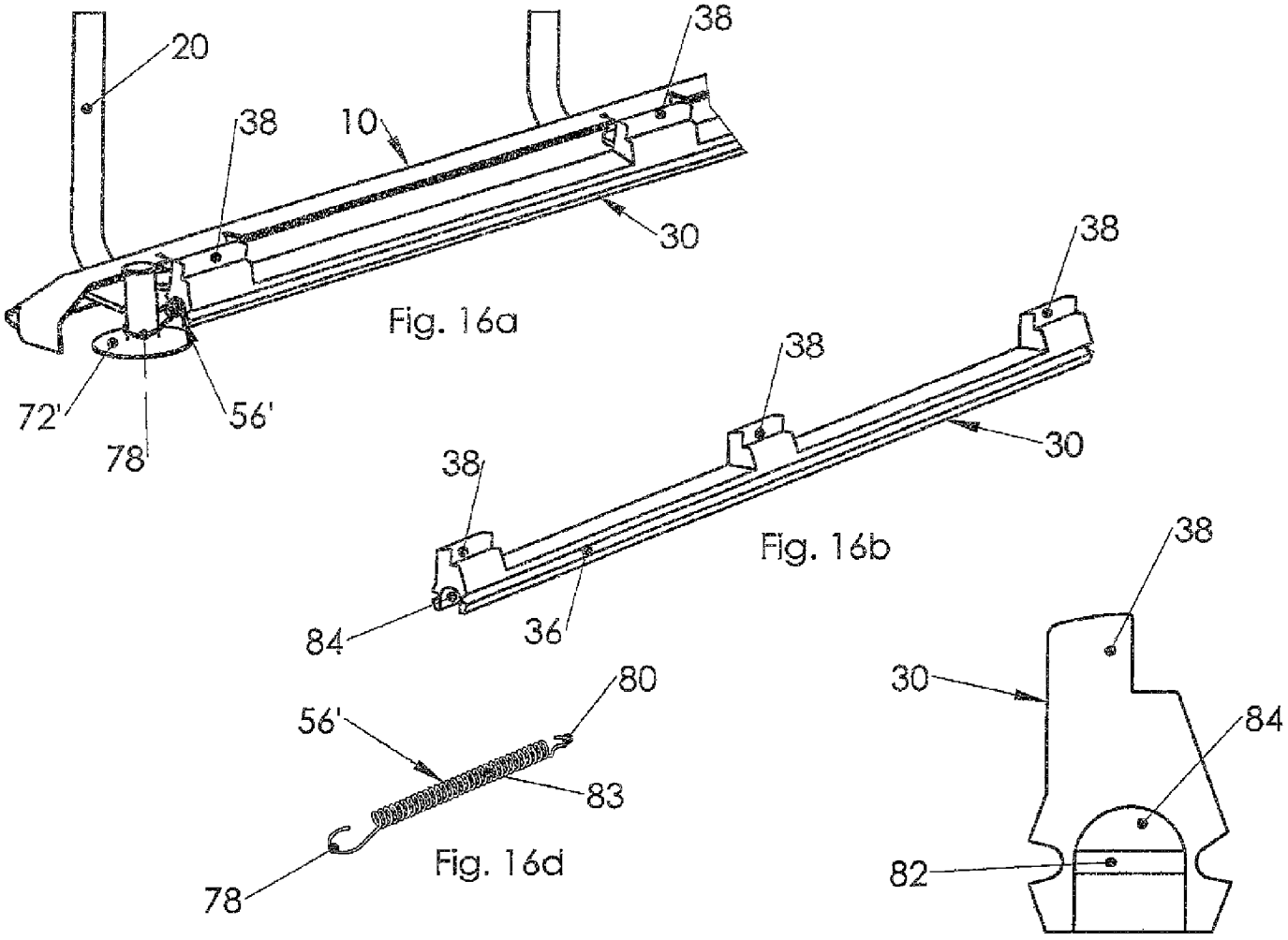
Figure 17B:
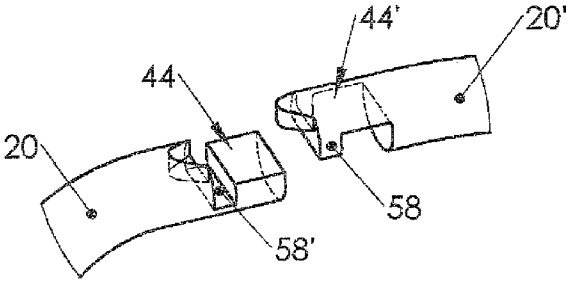
Figure 17A:
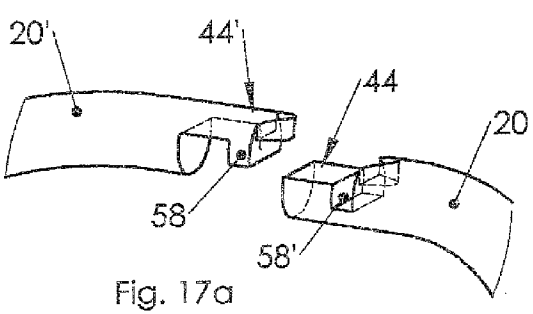
Figure 17E:
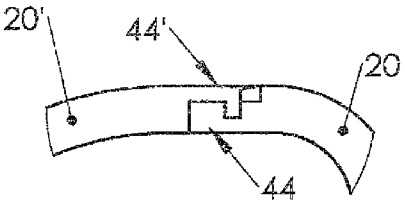
Figure 17D:
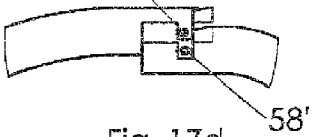
Figure 17C:
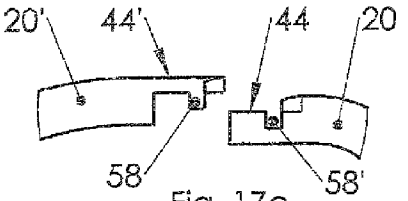
Figure 17H:
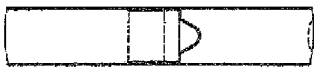
Figure 17G:
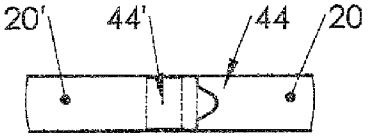
Figure 17F:
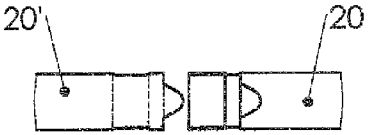
Figure 18B:
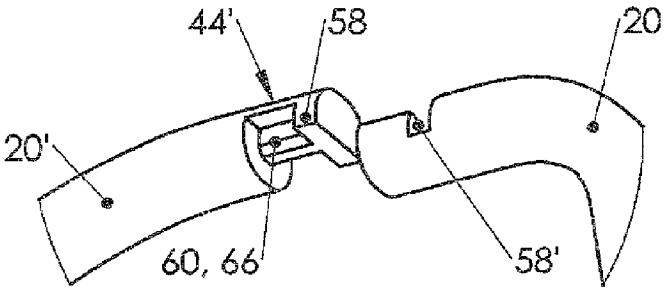
Figure 18A:
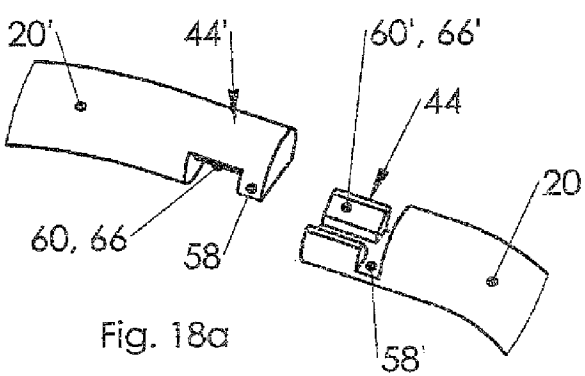
Figure 18E:
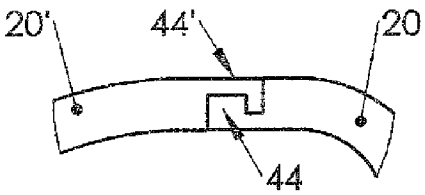
Figure 18D:
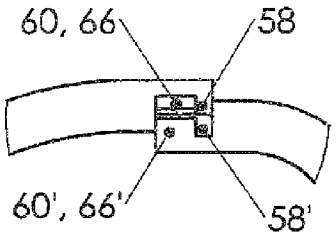
Figure 18C:
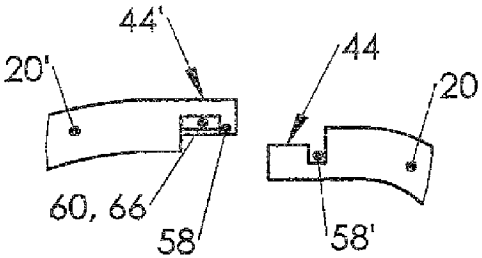
Figure 18H:
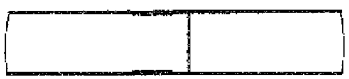
Figure 18G:
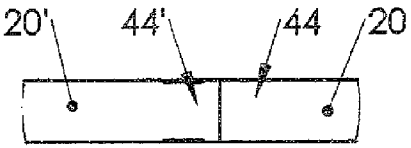
Figure 18F:
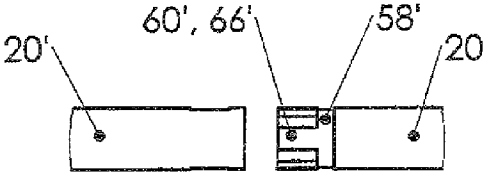
Figure 19B:
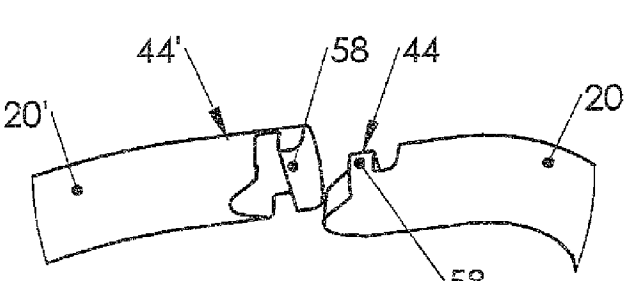
Figure 19A:
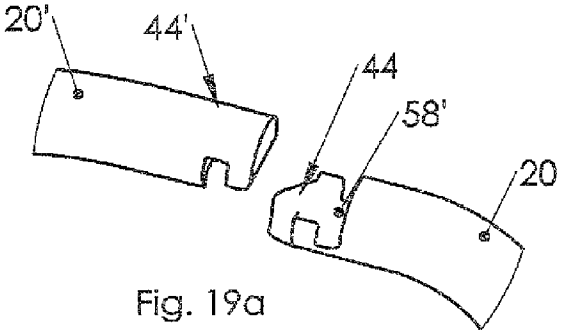
Figure 19E:
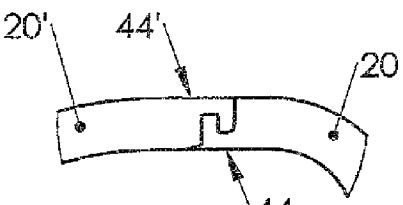
Figure 19D:
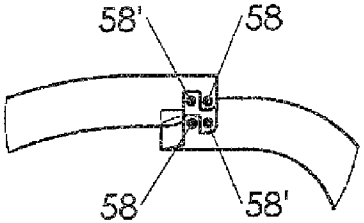
Figure 19C:
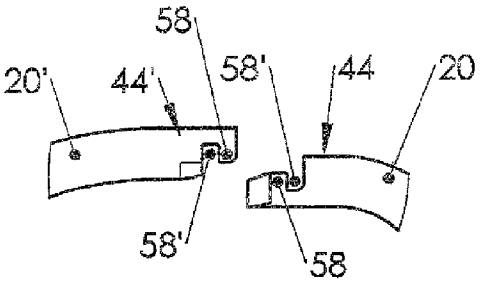
Figure 19H:
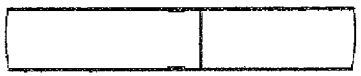
Figure 19G:
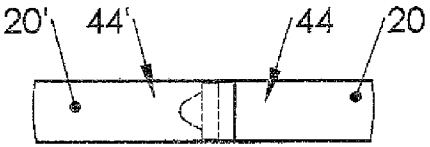
Figure 19F:
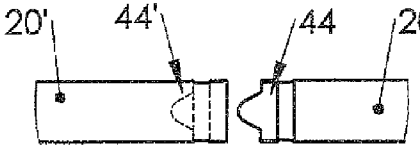

FIGS. 16*a* to *d* show a further exemplary embodiment of a ring binder mechanism with a pretensioning spring in an exploded schematic view (FIG. 16*a*) and in detailed views of the control rail (FIGS. 16*b* and *c*) and the pretensioning spring (FIG. 16*d*);

FIGS. 17*a* to *h* show a second variant of the locking elements of two associated half-rings in views according to FIGS. 8*a* to *h;*

FIGS. 18*a* to *h* show a third variant of the locking elements of two associated half-rings in views according to FIGS. 8*a* to *h;*

FIGS. 19*a* to *h* show a fourth variant of the locking elements of two associated half-rings in views according to FIGS. 8*a* to *h* and FIGS. 20*a* to *h* show a fifth variant of the locking elements of two associated half-rings in views according to FIGS. 8*a* to *h*.

The ring binder mechanisms shown in the drawings are primarily intended for receiving loose-leaf, hole-punched sheets, for example written material or printed products. Each ring binder mechanism comprises a housing 10 which is C-shaped in cross section and which comprises a central housing wall 12 and two lateral housing flanks 16 bent back relative to the central housing wall 12 forming bearing grooves 14 (FIG. 7). Moreover, in the exemplary embodiments shown, three half-rings 20, 20' are provided, arranged at a defined longitudinal spacing from one another and complementing one another in pairs to form a ring 18, as well as an actuating member 22 for opening and closing the rings 18. The half-rings 20, 20' are fastened at their roots 24, 24' rigidly to two carrier rails 26, 26' which at their inner longitudinal edges 28, 28' facing one another bear against one another indirectly via a control rail 30, forming a joint mechanism, and with their outer longitudinal edges 32, 32' remote from one another engage in the bearing grooves 14 of the housing 10 facing one another.

As is visible from FIGS. 6*a* to *d*, the control rail 30 is rotatable to a limited extent about a longitudinal axis 34 parallel to the housing longitudinal axis and is displaceably arranged in the housing 10, transversely to the central housing wall 12. The control rail comprises two longitudinal grooves 36, 36', open on opposing sides, into which in each case one of the carrier rails 26, 26' engages with its inner longitudinal edge 28, 28', forming an axis of articulation. In the exemplary embodiments shown, three control cams 38 are arranged spaced apart from one another on the control rail 30, said control cams with their front face being supported in the interior of the housing 10 on guide surfaces 40 fixed to the housing, and in the open position engaging through one respective guide opening 42 in the central housing wall 12 toward the housing exterior. Further details will be provided below about the function of the control rail 30 with its control cams 38 and the guide surfaces 40.

As is visible, in particular, from FIGS. 1 to 4, the half-rings 20 of a first group and the half-rings 20' of a second group are rigidly connected together in the region of their roots 24, 24' in a grouped manner via the carrier rails 26, 26' and as a result kept spaced apart from one another. The half-rings 20 of the one group are in each case pivotable relative to the half-rings 20' of the other group from an open position opening up an insert gap 43 between their free ends (FIG. 1*b*) to a closed position, in each case complementing one another to form a closed ring 18 (FIG. 1*a*). At the ends of the half-rings 20, 20' associated with one another are arranged mutually complementary locking bar elements 44, 44', locked together in the closed position to prevent pivoting of the half-rings 20, 20', said locking bar elements ensuring that the half-ring pairs 20, 20' are not able to open in the locked position, even under load.

Figure 5B:
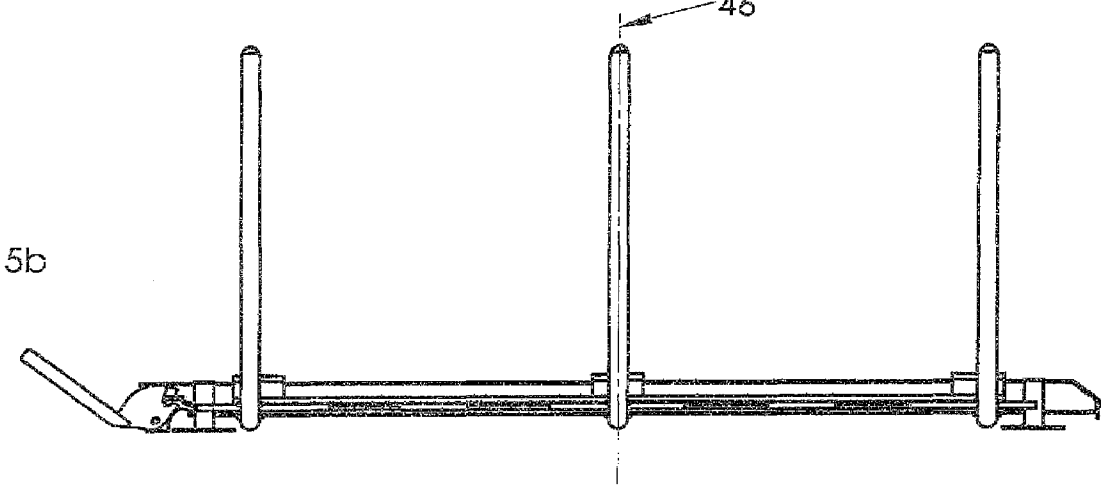

During the course of an unlocking procedure, the half-rings 20 of the one group are able to be moved relative to the half-rings 20' of the other group by initiating an unlocking procedure between a locked position (FIG. 6*a*) and a released position (FIG. 6*b*) of the associated locking bar elements 44, 44'. In contrast, during the course of a locking procedure, the half-rings 20, 20' are able to be moved between the released position and the locked position of the associated locking bar elements 44, 44'. In the locked position, the half-rings 20, 20' associated in pairs with one another span a common radial plane 46 (FIG. 5*a*), wherein their locking bar elements are coupled together positively (FIG. 6*a*). During the transition into the released position of the locking bar elements 44, 44' according to FIG. 6*b*, the half-rings 20, 20' in each case remain in their common radial plane 46 (FIG. 5*b*) but with the difference that their locking bar elements are radially spaced apart from one another (FIG. 6*b*, FIG. 7). As a result, it is possible for the locking bar elements 44, 44' in the locked position to be coupled positively together in all directions within the tangential plane 48 (FIG. 5*a*, 6*a*) of the rings 18 which is perpendicular to the radial plane 46 and which intersects the locking bar elements 44, 44'. The locking bar elements 44, 44' in the locked position are in contact with one another perpendicular to the tangential plane 48. Moreover, the half-rings 20, 20' associated with one another in pairs, in the locked position of the locking bar elements 44, 44' thereof, are positioned radially without clearance in the region of their roots 24, 24' via the control cams 38 bearing against the guide surface 40 on the central housing wall 12 (FIG. 6*a*). In order to be able to bring about the locked and unlocked state indicated by FIGS. 6*a* and *b*, during the unlocking procedure between the locked position and the released position and during the locking procedure between the released position and the locked position, the two half-ring groups 20, 20' carry out a common, aligned pivoting movement about pivot axes parallel to one another in the region of their roots 24, 24', more specifically about the outer longitudinal edges 32, 32'. This movement sequence, as explained further below, is controlled by the control rail 30 with its control cams 38. The carrier rails 26, 26' also contribute thereto, said carrier rails being pivotable to a limited extent relative to one another via the joint mechanism along a pivoting path by entraining the half-rings 20, 20' between the open position and the unlocked closed position.

A particularity of this movement sequence is that at least one of the carrier rails 26 is able to be moved relative to the other carrier rail 26' by initiating an unlocking procedure along an unlocking path between a locked position and a released position of the associated locking bar elements 44, 44' and that the at least one carrier rail 26 is able to be moved relative to the other carrier rail 26' by initiating a locking procedure along a locking path between the released position (FIG. 6*b*) and the locked position (FIG. 6*a*) of the associated locking bar elements 44, 44'.

During the course of the opening and closing procedure, by the action of the control rail 30, the carrier rails 26, 26' are pivotable between the locked position and the released position of the associated locking bar elements 44, 44' in the same direction (FIGS. 6*a* and *b*) and are pivotable between the released position and the open position of the associated half-rings 20, 20' in opposing directions (FIGS. 6*c* and *d*). During the opening and closing procedure, by the action of the control cams 38 and by pivoting the half-rings 20, 20' in opposing directions, this movement sequence is due to the control rail 30 being displaceable along the pivoting path between the open position and the released position of the locking bar elements 44, 44' on a displacement portion transversely to its longitudinal axis (FIGS. 6*c* and *d*), whilst said control rail is rotatable to a limited extent along the locking path between the released position and the locked position of the associated locking bar elements 44, 44' on a pivot portion (FIGS. 6*a* and *b*). In order to permit this, the central housing wall 12 has one respective guide opening 42 for the passage of the control cams 38 on the displacement portion of the control rail 30, whilst the central housing wall 12 also has one respective guide surface 40 for the control cams adjoining the guide opening 42 on the inside of the housing, aligned transversely to the longitudinal extent of the housing, on the pivot portion of the control rail 30. At the transition between the guide surfaces 40 and the guide openings 42, at the end of the locking path the control cams 38 come into contact with one respective stop 50 fixed to the housing, said stop being aligned with the outer edge of the associated guide opening 42 (FIG. 6*b*) and thus limiting the pivot portion of the control rail 30 toward the open position (FIG. 7).

The lateral bent-back portion 51 on the control cams 38 also ensures that, during the further opening procedure, by rotating the control rail 30 further, the height of the inner longitudinal edges 32, 32' of the carrier rails 26, 26' is compensated by offsetting the dimension a (FIG. 7). As a result, it is ensured that the latching elements 44, 44' in the released position have a sufficient radial spacing from one another such that they may be reliably separated from one another in the direction of the open position.

During the closing procedure, in this case by means of the bent-back portion 51 on the control rail, a lever arm with the dimension "a" is set, which ensures that by the action of the spring force of the housing flanks on the control rail 30 a torque is produced in the locking direction. In this case, a separate pretensioning spring is unnecessary.

A first variant of the locking bar elements 44, 44' which are intended to be coupled positively together in the locked position in all directions within the common tangential plane 48 of the closed half-rings 20, 20', perpendicular to the radial plane 46, is shown in FIGS. 8*a* to *h*. Further variants of the mutually complementary locking bar elements 44, 44' are found in the sets of FIGS. 17*a* to *h*, 18*a* to *h*, 19*a* to *h*, 20*a*, to *h*. The locking bar elements 44, 44' in all these variants have mutually complementary latching means, engaging in one another radially, producing a positive connection in the peripheral direction and transversely to the peripheral direction. A portion of these latching means in this case may take the form of mutually complementary transverse ribs 58 and transverse grooves 58' (FIGS. 17, 19). A further portion of the latching means may take the form of mutually complementary longitudinal ribs 60 and longitudinal grooves 60' (FIG. 18). Furthermore, latching means may be provided in the form of mutually complementary hook elements 62 and hook receivers 62' (FIG. 20) or cams 64 and cam receivers 64' (FIG. 8). A further set of latching means may have mutually complementary prisms 66 or prism receivers 66' able to be joined together radially (FIG. 18). In the variants shown, the transverse ribs 58, longitudinal ribs 60, hook elements 62, cams 64 and/or prisms 66 and the associated transverse grooves 58', longitudinal grooves 60', hook receivers 62', cam receivers 64' and/or prism receivers 66' have cross sections which may be joined together radially, from the group including a rectangle, trapezium and/or partial circle.

A further particularity of the invention is that the actuating member 22 has one respective opening arm 52 and closing arm 54 acting on one of the carrier rails 26' in the opening or closing direction. The opening and closing arms 52, 54 are in this case arranged such that, during the unlocking procedure, the control rail 30 rotates about its longitudinal axis 34 by the action of the opening arm 52 on the relevant carrier rail 26. Moreover, the control cams 38 contribute to this rotation, said control cams being supported in a suitable manner on the guide surfaces 40.

In order to ensure a reliable locking procedure, by the action of a spring force the control rail 30 is also pretensioned in the operative direction toward the locked position of the locking bar elements 44, 44'. Different options are available therefor, which are indicated in the drawings in FIGS. 13*a* to *e*, 14*a* to *c* as well as in FIG. 15*a*, to *c*, 16*a* to *e*. Thus in the case of FIGS. 13*a* to *e*, 14*a* to *c* a pretensioning spring 56 is provided, fixed at its one end to the housing and fixed at its other end to the control rail, via which the control rail 30 is pretensioned in the direction of the locked position. The pretensioning spring 56, which is configured as a torsion spring, is fixed with a bearing projection 70 aligned transversely to the torsion portion 77 to a bearing 72 fixed to the housing and engages with a drive element 74, arranged at the other end of the torsion spring and aligned perpendicular to the torsion portion 77, in a drive element slot 76 of the control rail 30. The bearing projection 70 and the drive element 74 are aligned relative to one another such that in the mounted state the torsion spring 56 produces a torsional stress, pretensioning the control rail 30 in the direction of the locked position.

The exemplary embodiment according to FIGS. 15*a* to *c* and 16*a* to *d* differs from the previous exemplary embodiment in that in this case a helical spring 56' is used as a torsion spring. The helical spring 56' is suspended with its bearing loop 78 arranged at one end in a bearing 72' fixed to the housing, whilst, with a drive element loop 80 protruding at the other end, it engages in a drive element slot 82 of the control rail 30. The helical torsion portion 83 of the spring 56' located between the bearing loop 78 and the drive element loop 80 is concealed in a spring guide channel 84 of the control rail 30. During assembly, the torsion portion 83 of the helical spring is twisted between the bearing loop 78 and the drive element loop 80 such that the control rail 30 is pretensioned in the direction of the locked position.

A further possibility in the case of FIG. 7 is to exert a torque on the control rail 30 in the operative direction toward the locked position, by the action of a force introduced via the resiliently pretensioned housing flanks 16 and the carrier rails 26, 26' in cooperation with the longitudinal grooves 36, 36' offset by the dimension "a", and as a result to produce a pretensioning.

In summary, the following is to be noted: the invention relates to a ring binder mechanism and has at least two half-ring pairs which are arranged spaced apart from one another and which consist in each case of two half-rings 20, 20', wherein the half-rings 20 of a first group and the half-rings 20' of a second group are rigidly connected together in a grouped manner in the region of their roots, and are thereby kept apart from one another. At the ends of the half-rings 20, 20' of at least one of the half-ring pairs mutually complementary locking bar elements 44, 44' are arranged, said locking bar elements being locked together to prevent pivoting of the half-rings in the closed position. A particularity of the invention is that the half-rings 20, 20' associated with one another in pairs in a released position span a common radial plane 46 and the locking bar elements 44, 44' thereof are radially spaced apart from one another and in that the locking bar elements 44, 44' in the locked position are positively coupled together in all directions within the tangential plane 48 of the rings 18 which is perpendicular to the radial plane 46 and which intersects the locking bar elements 44, 44'.

LIST OF REFERENCE NUMERALS

10 Housing
12 Housing wall
14 Bearing grooves
16 Housing flanks
18 Ring
20, 20' Half-rings
24, 24' Roots
26, 26' Carrier rails
28, 28' Inner longitudinal edges
30 Control rail
32, 32' Outer longitudinal edges
34 Longitudinal axis
36, 36' Longitudinal grooves
38 Control cams
40 Guide surface
42 Guide opening
43 Insert gap
44, 44' Locking bar elements
46 Radial plane
48 Tangential plane
50 Stop
51 Bent-back portion
52 Opening arm
54 Closing arm
56, 56' Pretensioning spring
58 Transverse rib
58' Transverse groove
60 Longitudinal rib
60' Longitudinal groove
62 Hook
62' Hook receiver
64 Cam
64' Cam receiver
66 Prism
66' Prism receiver
70 Bearing projection
72 Bearing fixed to housing
72' Bearing fixed to housing
74 Drive element
76 Drive element slot
77 Torsion portion
78 Bearing loop
80 Drive element loop
82 Drive element slot
83 Torsion portion
84 Spring guide channel

The invention claimed is:

1. A ring binder mechanism comprising:

at least two half-ring pairs, which are arranged spaced apart from one another, and which each comprise two half-rings, and an elongated housing which is C-shaped or U-shaped in cross section, has a central housing wall, has two housing flanks bent back laterally relative to the central housing wall forming bearing grooves, and has two elongated carrier rails arranged in the housing, wherein the half-rings of a first group and the half-rings of a second group are rigidly connected to one another in a grouped manner in the region of their roots and thereby kept apart from one another, said half-rings complementing one another in pairs to form the half-ring pairs, and being able to be pivoted together relative to the respective other group between an open position opening up an insert gap between their free ends and a closed position, complementing one another to form one respective closed ring, wherein at the ends of the half-rings of at least one of the half-ring pairs mutually complementary locking bar elements are arranged, said locking bar elements being locked together in the closed position to prevent pivoting of the half-rings, wherein at the start of an opening procedure at least one of the half-rings of the half-ring pairs is able to be moved relative to the other half-ring by initiating an unlocking procedure between a locked position and a released position of the associated locking bar elements, wherein during the course of a locking procedure at least one of the half-rings of the half-ring pairs is able to be moved relative to the other half-ring between the released position and the locked position of the associated locking bar elements, wherein in the locked position the half-rings associated with one another in pairs span a common radial plane and the locking bar elements thereof are positively coupled together at least in the opening direction of the half-rings, wherein in the released position, the half-rings associated with one another in pairs, span a common radial plane and the locking bar elements thereof are radially spaced apart from one another, wherein in the locked position, the locking bar elements are positively coupled together in all directions within the tangential plane of the rings which is perpendicular to the radial plane and which intersects the locking bar elements, wherein said carrier rails are operatively connected to controllers arranged between the longitudinal edges, forming a joint mechanism in the region of their longitudinal edges facing one another and with their outer longitudinal edges remote from one another engage in the bearing grooves, wherein the half-rings of one of the half-ring groups are rigidly arranged on each carrier rail, wherein in each case two pairs of half-rings associated with one another within the half-ring groups, on the outside of the housing, form half-ring pairs complementing one another in the closed position to form a ring, wherein the carrier rails are pivotable to a limited extent relative to one another via the joint mechanism along a pivoting path by driving the half-rings between the open position and the closed position, wherein at least one of the carrier rails is able to be moved relative to the other carrier rail by initiating an unlocking procedure along an unlocking path between a locked position and a released position of the associated locking bar elements, and wherein the at least one carrier rail is able to be moved relative to the other carrier rail by initiating a locking procedure along a locking path between the released position and the locked position of the associated locking bar elements.

2. The ring binder mechanism as claimed in claim 1, wherein in the locked position the locking bar elements come into contact with one another perpendicular to the tangential plane.

3. The ring binder mechanism as claimed in claim 1, wherein the half-rings associated with one another in pairs, in the locked position of the locking bar elements thereof, are positioned radially without play in the region of their roots.

4. The ring binder mechanism as claimed in claim 1, wherein during the unlocking procedure between the locked position and the released position of the locking bar elements, the two half-ring groups carry out a common, aligned pivoting movement about pivot axes parallel to one another in the region of the half-ring roots.

5. The ring binder mechanism as claimed in claim 1, wherein during the locking procedure between the released position and the locked position of the locking bar elements, the two half-ring groups carry out a common, aligned pivoting movement about pivot axes parallel to one another in the region of the half-ring roots.

6. The ring binder mechanism as claimed in claim 1, wherein the locking bar elements of the half-rings belonging to a half-ring pair have mutually complementary latches which engage in one another radially and produce a positive connection in the peripheral direction and transversely to the peripheral direction.

7. The ring binder mechanism as claimed in claim 6, wherein at least one portion of the latches has the form of mutually complementary transverse ribs and transverse grooves.

8. The ring binder mechanism as claimed in claim 6, wherein at least one portion of the latches has the form of mutually complementary longitudinal ribs and longitudinal grooves.

9. The ring binder mechanism as claimed in claim 6, wherein at least one portion of the latches has the form of mutually complementary hook elements and hook receivers.

10. The ring binder mechanism as claimed in claim 6, wherein at least one portion of the latches has the form of mutually complementary cams and cam receivers.

11. The ring binder mechanism as claimed in claim 10, wherein the cam receivers have cross sections which may be joined together radially, from the group including a rectangle, trapezium and/or partial circle.

12. The ring binder mechanism as claimed in claim 6, wherein at least one portion of the latches has the form of mutually complementary prisms or prism receivers able to be joined together radially.

13. The ring binder mechanism as claimed in claim 1, wherein during the course of the opening and closing procedure the carrier rails are pivotable in the same direction by the action of the controllers, between the locked position and the released position of the associated locking bar elements, and said carrier rails are pivotable in opposing directions between the released position and the open position of the associated half-rings.

14. The ring binder mechanism as claimed in claim 13, wherein at the end of the locking path on the released side the control cam comes into contact with a stop fixed to the housing, said stop being aligned with an opening edge of the guide opening.

15. The ring binder mechanism as claimed in claim 13, wherein the control rail is pretensioned by the action of a spring force in the operative direction toward the locked position of the locking bar elements.

16. The ring binder mechanism as claimed in claim 15, comprising a pretensioning spring, fixed at its one end to the housing and fixed at its other end to the control rail, via which the control rail is pretensioned in the direction of the locked position.

17. The ring binder mechanism as claimed in claim 1, wherein the controllers form a control rail which is rotatable to a limited extent about a longitudinal axis parallel to the housing longitudinal axis, and which is displaceable transversely to the central housing wall, said control rail having two longitudinal grooves open on opposing sides, into which in each case one of the carrier rails engages with its inner longitudinal edge, forming an axis of articulation, and wherein during the opening and closing procedure the control rail is displaceable on a displacement portion transversely to the longitudinal axis thereof, by the action of a control cam supported on at least one guide surface fixed to the housing or guide opening by pivoting the half rings in opposing directions along the pivoting path between the open position and the released position of the locking bar elements and the control rail is rotatable to a limited extent on a pivot portion by pivoting the half-rings in the same direction along the locking path between the released position and the locked position of the associated locking bar elements.

18. The ring binder mechanism as claimed in claim 17, wherein the central housing wall has at least one guide opening for the passage of the at least one control cam on the displacement portion of the control rail and wherein the central housing wall also has a guide surface for the control cam on the pivot portion of the control rail, said guide surface being adjacent to the guide opening on the inside of the housing and being aligned transversely to the longitudinal extent of the housing.

19. The ring binder mechanism as claimed in claim 1, further comprising an actuating member which has at least one opening and closing arm acting on one of the carrier rails in the opening and closing direction.

20. The ring binder mechanism as claimed in claim 19, wherein the control rail rotates about its longitudinal axis during the unlocking procedure by the action of the opening arm as well as the relevant carrier rail.

21. The ring binder mechanism as claimed in claim 19, wherein the control rail rotates about its longitudinal axis during the locking procedure by the action of the closing arm as well as the relevant carrier rail.

22. The ring binder mechanism as claimed in claim 21, wherein the control rail is pretensioned in the operative direction toward the locked position, by the action of a spring force transmitted via the housing flanks onto the carrier rails.

* * * * *